US009902159B2

(12) United States Patent
Hatano et al.

(10) Patent No.: US 9,902,159 B2
(45) Date of Patent: Feb. 27, 2018

(54) INKJET RECORDING APPARATUS AND INK CONTAINER

(71) Applicant: Roland DG Corporation, Hamamatsu-shi, Shizuoka (JP)

(72) Inventors: Yoshitaka Hatano, Hamamatsu (JP); Takayoshi Oguri, Hamamatsu (JP); Hironori Watanabe, Hamamatsu (JP)

(73) Assignee: ROLAND DG CORPORATION, Shizuoka (JP)

( * ) Notice: Subject to any disclaimer, the term of this patent is extended or adjusted under 35 U.S.C. 154(b) by 0 days.

(21) Appl. No.: 15/248,218

(22) Filed: Aug. 26, 2016

(65) Prior Publication Data

US 2017/0057236 A1 Mar. 2, 2017

(30) Foreign Application Priority Data

Aug. 28, 2015 (JP) ..... 2015-169130

(51) Int. Cl.

| | |
|---|---|
| ***B41J 2/175*** | (2006.01) |
| ***B41J 29/02*** | (2006.01) |
| ***B41J 29/13*** | (2006.01) |

(52) U.S. Cl.

CPC ..... *B41J 2/1752* (2013.01); *B41J 2/17523* (2013.01); *B41J 2/17553* (2013.01); *B41J 2/17566* (2013.01); *B41J 29/02* (2013.01); *B41J 29/13* (2013.01)

(58) Field of Classification Search

None

See application file for complete search history.

(56) References Cited

U.S. PATENT DOCUMENTS

2009/0290001 A1* 11/2009 Domae ..... B41J 2/17513 347/85
2016/0031225 A1* 2/2016 Fujimori ..... B41J 2/17566 347/6

FOREIGN PATENT DOCUMENTS

| | | | |
|---|---|---|---|
| JP | 09-024624 | A | 1/1997 |
| JP | 2007-083680 | A | 4/2007 |
| JP | 2009-034989 | A | 2/2009 |
| JP | 2009-279876 | A | 12/2009 |
| JP | 2010-149461 | A | 7/2010 |
| JP | 2011-088365 | A | 5/2011 |
| JP | 2013-086367 | A | 5/2013 |
| JP | 2013-208740 | A | 10/2013 |

* cited by examiner

*Primary Examiner* — Matthew Luu
*Assistant Examiner* — Tracey McMillion
(74) *Attorney, Agent, or Firm* — Keating & Bennett, LLP

(57) ABSTRACT

An ink cartridge of an inkjet printer includes a support holding an ink container so that a longitudinal direction of a main body of the ink container extends along a sub-scanning direction of the inkjet printer, and supporting a portion of the main body that is perpendicular or substantially perpendicular to a thickness direction of the main body such that the main body is supported horizontally. A central portion of the support is lower in height than a left portion and a right portion thereof with respect to a main scanning direction of the inkjet printer.

15 Claims, 10 Drawing Sheets

INKJET RECORDING APPARATUS AND INK CONTAINER

CROSS REFERENCE TO RELATED APPLICATIONS

The present application claims priority to Japanese Patent Application No. 2015-169130 filed on Aug. 28, 2015, which is incorporated by reference herein in its entirety.

BACKGROUND OF THE INVENTION

1. Field of the Invention

The present invention relates to an inkjet recording apparatus including an ink cartridge in which an ink container is disposed, and to the ink container.

2. Description of the Related Art

Inkjet recording apparatuses that use ink such as aqueous ink are conventionally known. In many cases, a large-sized inkjet recording apparatus consumes a large amount of ink, and therefore, it requires replacement of an ink cartridge containing an ink container at a considerably high frequency. Because the ink cartridge is high in cost, replacement of the ink cartridge containing the ink container itself places a high cost burden on the user. In view of this problem, the configuration that requires only the replacement of the ink containers, not the replacement of the ink cartridge, has been proposed (see, for example, JP 2009-279876 A). With this configuration, once the ink is used up, the user may purchase another ink container only and fit the purchased ink container into the ink cartridge. This enables the user to reuse the ink cartridge.

However, it is not easy for the user to find a proper installation position of the ink container relative to the ink cartridge, so in some cases, misalignment of the ink container relative to the ink needle occurs. In order to solve the problem as described above, JP 2009-279876 A discloses an adapter to be fitted to an ink container cap (also referred to as "spout") of the ink container. The adapter is configured to be attached to a supply port side of the ink container and fitted into a predetermined position in the ink cartridge. This facilitates the user's proper positioning of the ink supply port relative to the ink needle.

In the above-described conventional technology, however, the support surface of the ink cartridge that supports the ink container has a flat, planer shape. Therefore, it is difficult to move and concentrate the ink to the ink supply port in the ink container. As a consequence, the ink often remains at the four corners within the ink container. This means that the ink container is replaced even before the ink in the ink container is used up sufficiently.

SUMMARY OF THE INVENTION

Preferred embodiments of the present invention provide an inkjet recording apparatus and an ink container that can use up ink within the ink container adequately.

An inkjet recording apparatus according to the present invention is an inkjet recording apparatus including an ink cartridge; an ink container disposed in the ink cartridge; wherein the ink container includes a main body including an ink, and a cap disposed at one end of the main body and extending partially in the main body; the ink cartridge includes a support holding the ink container and supporting a portion of the main body; and the support includes a central portion that is lower in height than a left portion and a right potion of the central portion with respect to a main scanning direction of the inkjet recording apparatus.

An inkjet recording apparatus according to a preferred embodiment of the present invention enables ink to easily gather at a center or approximate center of the main body from the left and right regions because the central portion of the support is lower in height than the left portion and the right portion. In other words, it is possible to gather or concentrate the ink, so to speak, at one point or area in the main body. This prevents a large amount of ink from remaining in the main body and allows the ink to flow out through the ink container cap adequately. As a result, it becomes possible to sufficiently use the ink in the main body. As a result, the cost of the ink is reduced.

In one preferred embodiment of the present invention, the support preferably has a circular or substantially circular arc shape, for example.

This structure enables the ink to more easily gather at the center or approximate center of the main body from the left and right regions of the main body. This prevents a large amount of ink from remaining in the main body.

In another preferred embodiment of the present invention, the support includes a first support inclined downward from the left portion toward the central portion, and a second support inclined downward from the right portion toward the central portion.

The structure of this preferred embodiment enables the ink to more easily gather and concentrate at the center of the main body from the left and right regions of the main body. This prevents a large amount of ink from remaining in the main body.

In another preferred embodiment of the present invention, the main body includes an upper surface and a lower surface, and the inkjet recording apparatus further includes an adapter attachable to and detachable from the ink container and being installed to the ink cartridge with the adapter fitted to the main body, and the adapter has a flat plate shape, and includes a securing portion and an adhesive-bonding portion on the securing portion to secure the main body to the adapter.

The structure of this preferred embodiment enables the lower surface of the main body to be secured to the securing portion of the adapter via the adhesive-bonding portion. This prevents the position of the ink container from being misaligned relative to the ink cartridge even if, for example, the ink cartridge is moved or dropped after the adapter having been attached to the ink container is installed to the ink cartridge. As a result, the ink is prevented from scattering in the main body, which results from the misalignment.

In another preferred embodiment of the present invention, the securing portion is positioned between a longitudinal center of the main body and the end portion of the main body on which the ink container cap is provided, with the adapter being attached to the main body.

The structure of this preferred embodiment enables a portion of the lower surface of the main body that is located between the center of the ink container with respect to the longitudinal direction and the end portion of the main body on which the ink container cap is provided to be secured to the securing portion of the adapter via the adhesive-bonding portion. This makes it possible to lower the height of a portion near the outlet of the main body and to prevent formation of puddles of unused ink.

In another preferred embodiment of the present invention, the support includes a cut-out portion along an outer periphery of the securing portion, and the securing portion is disposed on the cut-out portion.

In the structure of this preferred embodiment, the circumferential wall of the cut-out portion blocks movement of the securing portion. Therefore, misalignment of the securing portion is prevented.

In another preferred embodiment of the present invention, the inkjet recording apparatus further includes a cartridge receiver accommodating the ink cartridge, and the cartridge receiver includes an ink tube joint and an inclined portion, the ink tube joint is connected to an ink tube and includes a flow passage connected to the ink tube, the ink tube joint includes a needle capable of piercing into the ink container cap to cause the ink in the main body to flow out, and the inclined portion is inclined downward toward the ink tube joint.

In the structure of this preferred embodiment, the ink cartridge is supported on the inclined portion so that the ink cartridge is inclined along the inclined portion. As a result, it becomes easy to gather and concentrate the ink in a region near the ink container cap in the main body that is disposed in the ink cartridge.

In another preferred embodiment of the present invention, an ink tub to store the ink is provided below the ink tube joint.

In the structure of this preferred embodiment, the ink tub receives the ink that drips from the ink container and flows down along the inclined portion of the cartridge receiver when the needle of the ink tube joint is pulled out from the ink container cap which has been pierced by the needle, i.e., when the ink cartridge is removed together with the ink container. This prevents the ink from flowing down toward the main housing of the inkjet printer.

In another preferred embodiment of the present invention, an ink absorber that absorbs the ink is provided in the ink tub.

The structures of this preferred embodiment enables the ink in the ink tub to be absorbed by the ink absorber. As a result, the ink storage capacity of the ink tub is increased.

In another preferred embodiment of the present invention, the inkjet recording apparatus further includes a pivot shaft, a sensor lever secured to the pivot shaft and pivotable about an axis of the pivot shaft to come into contact with an upper surface portion of the main body that is located frontward relative to a portion of the cap, a detection lever secured to the pivot shaft and pivoting about the axis of the pivot shaft in association with pivoting of the sensor lever, a photosensor detecting a position of a tip of the detection lever, by emitting light toward the tip of the detection lever and receiving light reflected from the tip of the detection lever, and a remaining ink amount detector that detects a remaining amount of the ink in the main body according to a voltage output by the photosensor.

In the structure of this preferred embodiment, the sensor lever that is in contact with the main body pivots as the remaining amount of the ink in the main body decreases. When the sensor lever pivots, the detection lever accordingly pivots, so that the position of the tip of the detection lever changes. By detecting the position of the tip of the detection lever with the photosensor, the amount of the ink remaining in the main body is able to be detected easily.

In another preferred embodiment of the present invention, the inkjet recording apparatus further includes a pivot shaft, a sensor lever secured to the pivot shaft and pivotable about an axis of the pivot shaft to come into contact with an upper surface portion of the main body that is located frontward relative to a portion of the cap, a detection lever secured to the pivot shaft and pivoting about the axis of the pivot shaft in association with pivoting of the sensor lever, a metal piece in contact with a tip of the detection lever, a strain gauge provided on the metal piece and outputting a voltage corresponding to a strain of the metal piece caused by a force imparted by the detection lever, and a remaining ink amount detector detecting a remaining amount of the ink in the main body according to the voltage output by the strain gauge.

In the structure of this preferred embodiment, the sensor lever that is in contact with the main body pivots as the remaining amount of the ink in the main body decreases. When the sensor lever pivots, the detection lever accordingly pivots, causing the metal piece to deform and producing strain in the metal piece. Such a structure makes it possible to easily detect the amount of the ink remaining in the main body according to the strain of the metal piece.

In another preferred embodiment of the present invention, the cartridge receiver includes a left wall connected to a left end of the inclined portion, a right wall connected to a right end of the inclined portion, and a top surface connected to an upper end of the left wall and an upper end of the right wall, the inclined portion, the left wall, the right wall, and the top surface together define an opening through which the ink cartridge is to be inserted, the cartridge receiver further includes a cover pivotable between a first position to close the opening and a second position to open the opening, and when the ink cartridge is not disposed at a predetermined position in the cartridge receiver, a front end of the ink cartridge is disposed frontward relative to a rear surface of the cover at the first position.

The structure of this preferred embodiment makes it possible to determine whether or not the cartridge has been placed at a predetermined position in the cartridge receptacle. That is, the operator is able to easily and accurately recognize that the ink cartridge is not placed at a predetermined position in the cartridge receiver when the cover cannot be closed because the rear surface of the cover makes contact with the front end of the ink cartridge. The operator may close the cover after placing the ink cartridge to a predetermined position in the cartridge receiver.

An ink container according to a preferred embodiment of the present invention is an ink container for use in an inkjet recording apparatus and includes a main body including an ink, and an ink outlet at one end of the main body and extending partially in the main body, wherein the main body includes an ink-holding portion having a first width, and an ink outflow portion that receives the ink from the ink-holding portion and provides the ink to the ink outlet, the ink outflow portion has a second width that is less than the first width and progressively narrows from the ink-holding portion toward the ink outlet.

The structure of this preferred embodiment enables a portion of the main body near the ink container cap to have an indented shape. This prevents formation of puddles of unused ink at the corners in the main body and makes it easy to gather and concentrate the ink at the ink outflow portion. In other words, it is possible to gather the ink to be collected and concentrate at one area or point in the main body. This prevents a large amount of ink from remaining in the main body and allows the ink to flow out through the ink container cap adequately. As a result, it becomes possible to sufficiently use the ink in the main body.

In one preferred embodiment of the invention, the main body includes an upper surface and a lower surface each preferably having a rectangular or substantially rectangular shape when viewed in plan, and the ink outflow portion is preferably formed by welding the upper surface and the lower surface together.

The structure of this preferred embodiment makes it possible to form the shape in which a portion of the main body that is near the ink container cap is depressed more easily by welding.

Various preferred embodiments of the present invention provide inkjet recording apparatuses and ink containers that use up the ink within the ink main body adequately.

The above and other elements, features, steps, characteristics and advantages of the present invention will become more apparent from the following detailed description of the preferred embodiments with reference to the attached drawings.

BRIEF DESCRIPTION OF THE DRAWINGS

FIG. 4-1 is a perspective view of an adapter according to a preferred embodiment of the present invention.

FIG. 4-2 is a cross-sectional view taken along line IV-II-IV-II in FIG. 4-1, illustrating an adapter according to a preferred embodiment of the present invention that is fitted to an ink cartridge.

DETAILED DESCRIPTION OF THE PREFERRED EMBODIMENTS

Figure 1:
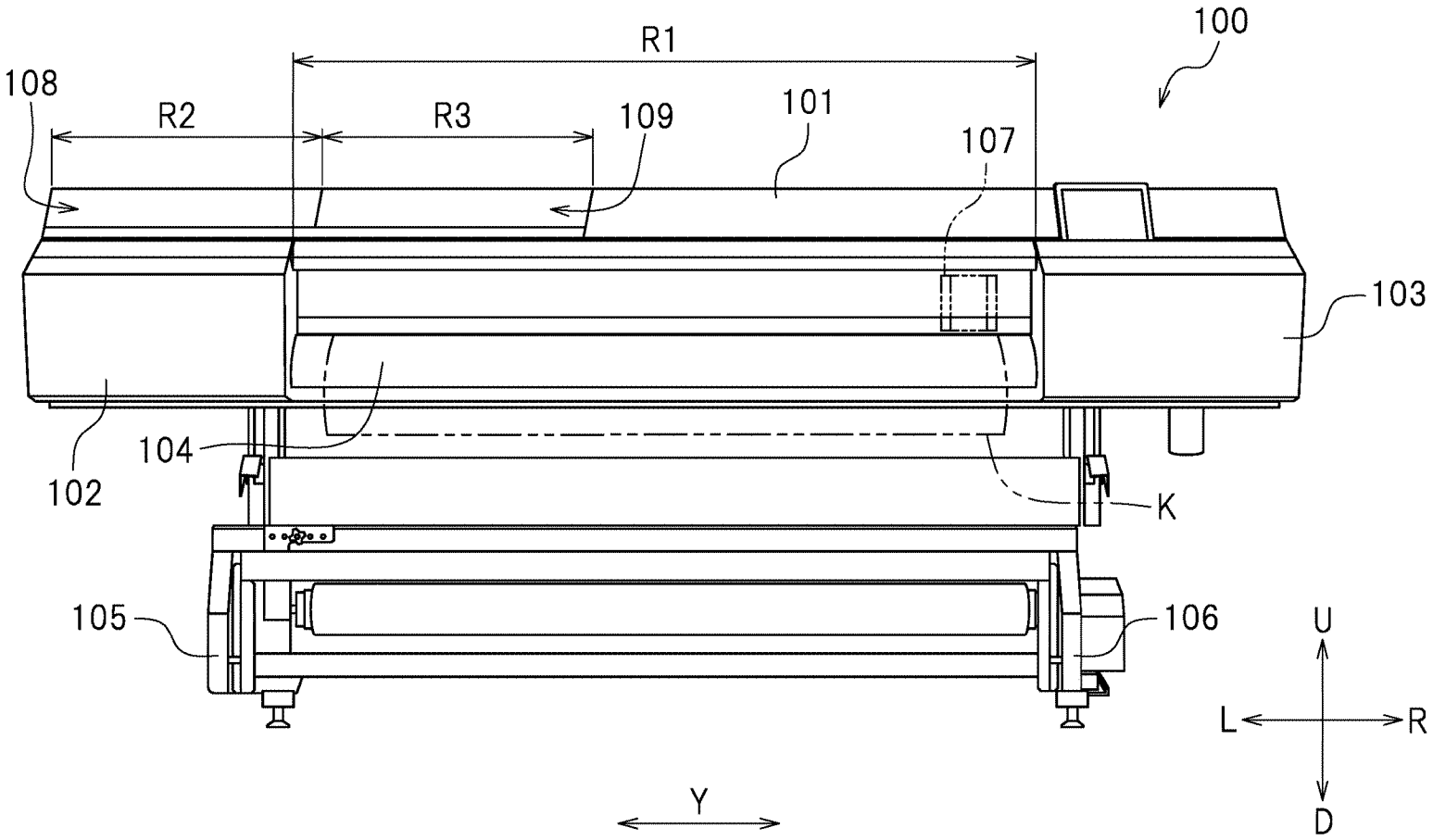
FIG. 1 is a front view illustrating an inkjet printer according to a preferred embodiment of the present invention.

Hereinbelow, preferred embodiments of the present invention will be described with reference to the drawings. An inkjet recording apparatus according to a preferred embodiment of the present invention is an inkjet printer 100 that performs printing on recording paper K as a recording medium. In the following description, the terms "left," "right," "up," and "down" respectively refer to left, right, up, and down as defined based on the perspective of the operator facing the inkjet printer 100. A direction toward the operator relative to the inkjet printer 100 is defined as "frontward," and a direction away from the operator relative to the inkjet printer 100 is defined as "rearward." In FIG. 1, reference characters F (see FIG. 2), Re (see FIG. 2), L, R, U, and D refer to front, rear, left, right, up, and down, respectively. These directional terms are, however, merely provided for purposes of illustration and are not intended to limit the arrangements of the inkjet printer 100 according to the preferred embodiments in any way. An ink head 107 is capable of moving leftward and rightward, and the recording paper K is capable of being transferred frontward and rearward. Where a direction in which the ink head 107 moves and a direction in which the recording paper K is transferred are referred to as "main scanning direction Y" and "sub-scanning direction X" (see FIG. 2), respectively, the main scanning direction Y corresponds to a lateral direction, i.e., a left-to-right/right-to-left direction, while the sub-scanning direction X corresponds to a longitudinal direction, i.e., a front-to-rear/rear-to-front direction. The main scanning direction Y and the sub-scanning direction X are perpendicular or substantially perpendicular to each other. It should be noted, however, that the main scanning direction Y and the sub-scanning direction X are not particularly limited thereto, and may be set appropriately, for example, depending on the type of the inkjet printer 100. The recording medium may be any other sheet-shaped recording medium, such as a resin sheet, for example. The recording medium is not limited to a flexible sheet-shaped medium, but may be a hard recording medium, such as a glass plate, for example.

As illustrated in FIG. 1, the inkjet printer 100 includes a main housing 101, sides 102, 103, a platen 104, legs 105, 106, an ink head 107, and cartridge receivers 108, 109 to respectively accommodate a plurality of later-described ink cartridges 1 (see FIG. 2). The main housing 101 is a housing extending in a lateral direction. The platen 104 capable of supporting the recording paper K is provided in the main housing 101. The side 102 of a housing is connected to a front left portion of the main housing 101. The side 103 of a housing is connected to a front right portion of the main housing 101. The legs 105 and 106 that support the main housing 101 are attached to a lower portion of the main housing 101. The leg 106 is positioned rightward relative to the leg 105. The ink head 107 is disposed in the main housing 101. The cartridge receivers 108 and 109 are provided in an upper left portion of the main housing 101. The cartridge receiver 109 is disposed to the right of the cartridge receiver 108 so as to be lined up with the cartridge receiver 108. Although the two cartridge receivers 108 and 109 are provided in the present preferred embodiment, it is also possible to provide only one cartridge receiver, or three or more cartridge receivers.

In FIG. 1, a region in which the recording paper K is disposed (i.e., the printing area) that extends in a lateral direction is defined as a region R1, a region of the cartridge receiver 108 that extends in a lateral direction is defined as a region R2, and a region of the cartridge receiver 109 that extends in a lateral direction is defined as a region R3. A portion of the region R2 overlaps the region R1 with respect to the lateral direction of the inkjet printer 100. The entirety of the region R3 overlaps the region R1 with respect to the lateral direction of the inkjet printer 100. In other words, a portion of the region R2 is positioned above the region R1, and the entirety of the region R3 is positioned above the region R1.

Figure 2:
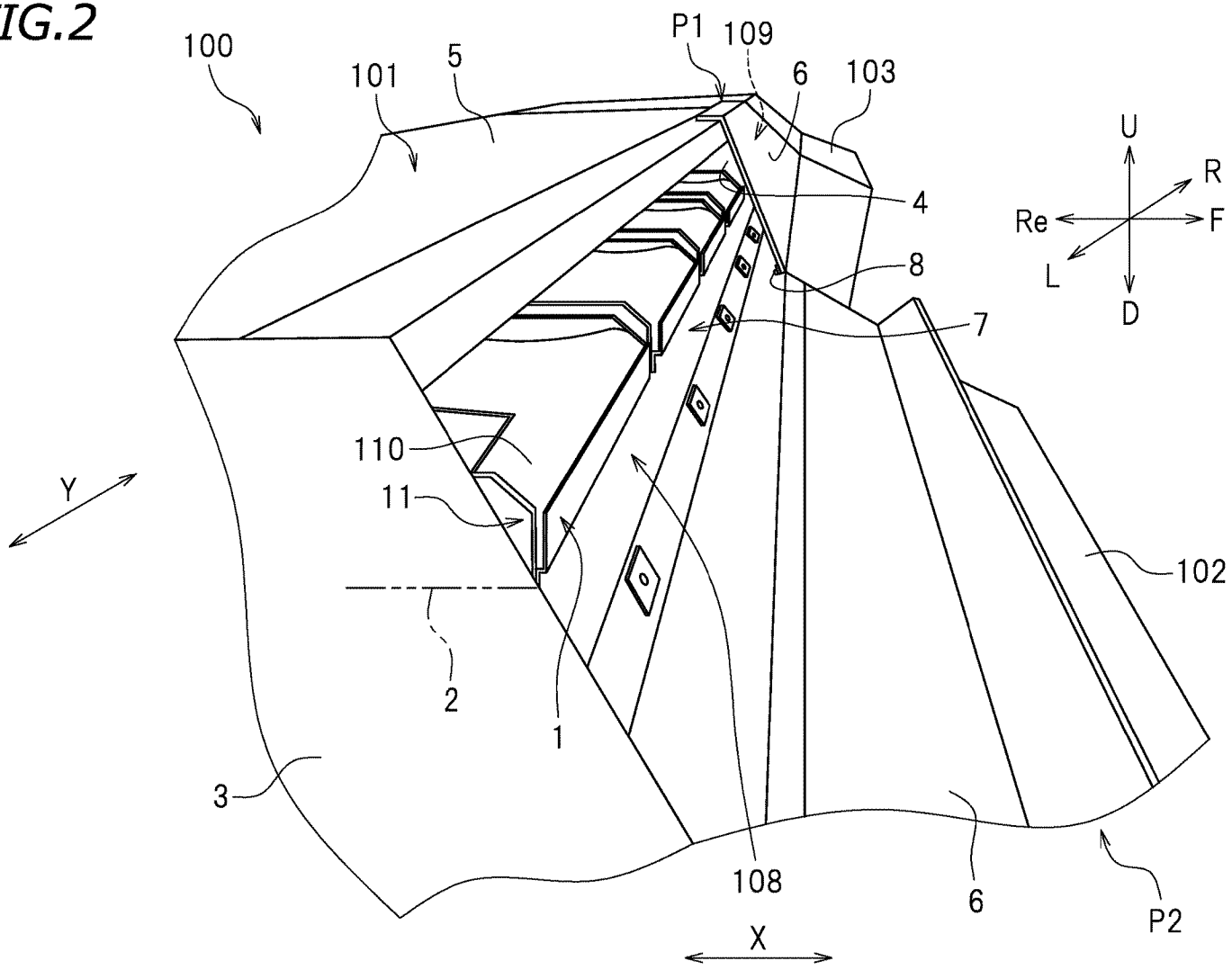
FIG. 2 is a perspective view illustrating an inkjet printer according to a preferred embodiment of the present invention, with a cover being open.
Figure 7:
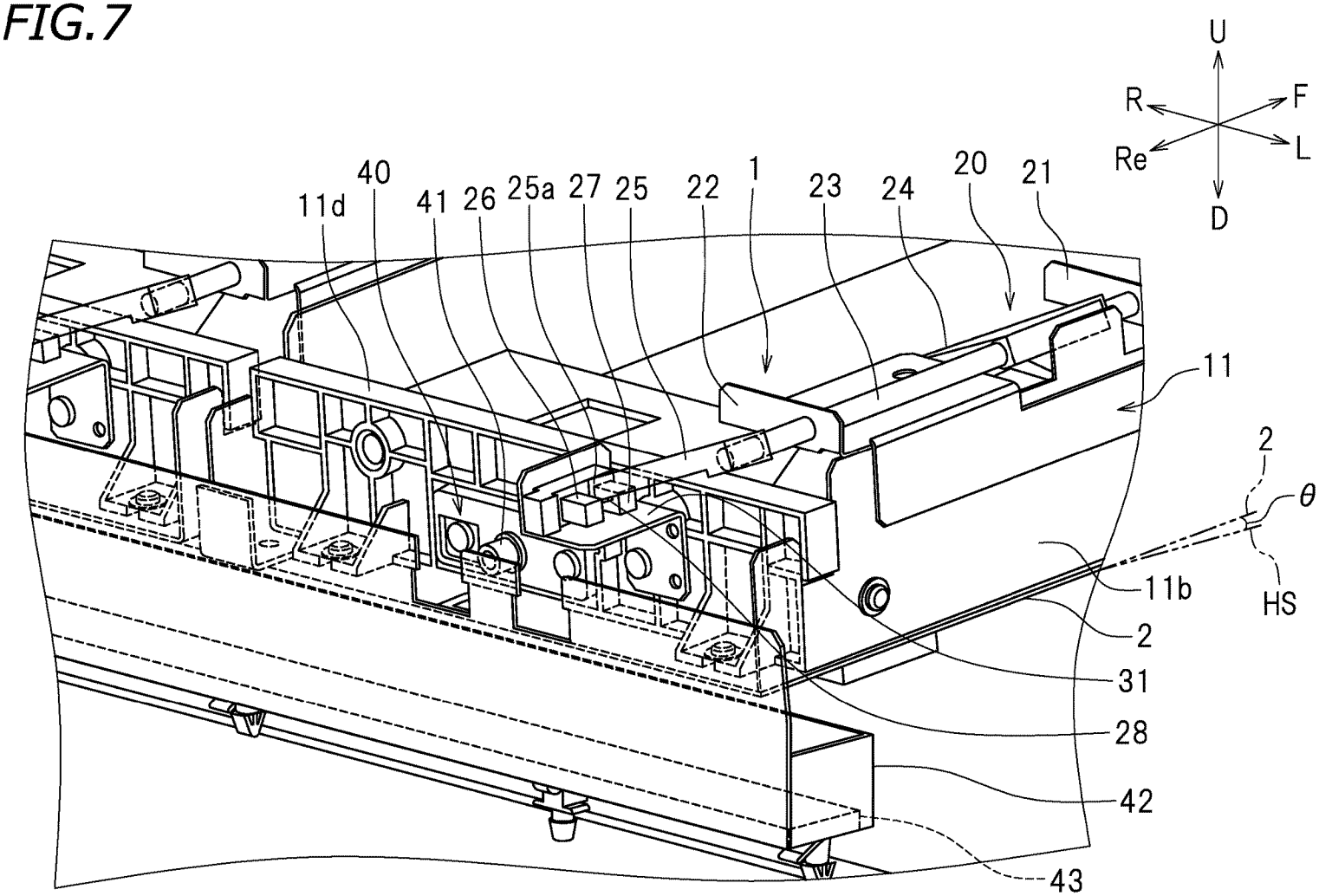
FIG. 7 is a perspective view illustrating an inclined portion and an ink tub according to a preferred embodiment of the present invention.

As illustrated in FIG. 2, the cartridge receiver 108 extends in a main scanning direction Y, i.e., in a lateral direction. The cartridge receiver 108 includes an inclined portion 2, a left wall 3, a right wall 4, a top surface 5, and a cover 6. The configuration of the cartridge receiver 109 is preferably the same as that of the cartridge receiver 108. For this reason, only the cartridge receiver 109 will be described in detail below. The inclined portion 2 supports an ink cartridge 1 that holds an ink container 110 including ink. The ink container 110 includes an ink with a color such as yellow (Y), magenta (M), cyan (C), black (K), or other colors. The inclined portion 2 is inclined downward toward the rear. As illustrated in FIG. 7, the inclination angle θ with respect to the horizontal surface HS of the inclined portion 2 preferably is, for example, about 5 degrees. Thus, the ink cartridge 1 supported by the inclined portion 2 is inclined downward toward the rear. Returning to FIG. 2, the left wall 3 is connected to the left end of the inclined portion 2. The right wall 4 is connected to the right end of the inclined portion 2. The top surface 5 is connected to the upper end of the left wall 3 and the upper end of the right wall 4. The inclined portion 2, the left wall 3, the right wall 4, and the top surface 5 together define an opening 7 into which the ink cartridge 1 is able to be inserted from the front toward the rear. FIG. 2 shows that the cartridge receiver 108 accommodates four ink cartridges 1, for example. Thus, together with the cartridge receiver 109, a total of eight ink cartridges 1 are preferably accommodated in the inkjet printer 100 according to the present preferred embodiment, for example. However, the number of the ink cartridges 1 to be accommodated in the inkjet printer 101 is not limited thereto.

Figure 9:
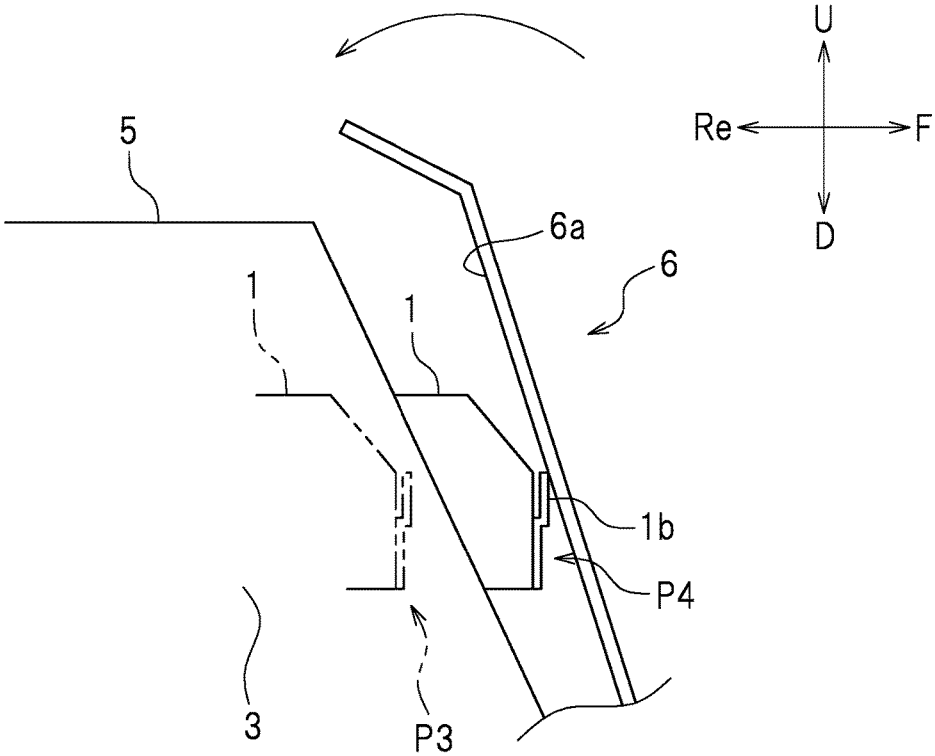
FIG. 9 is an illustrative view illustrating that a cover 6 does not close, according to a preferred embodiment of the present invention.

The cover 6 is allowed to open frontward by a hinge 8 connected to a lower portion of the cover 6. Thus, the cover 6 is pivotable between a first position P1, at which it closes the opening 7, and a second position P2, at which it opens the opening 7. The cover 6 makes contact with an upper portion of the side 102 when it is at the second position P2. This restricts the cover 6 to the second position P2 so as not to open any further. Here, as illustrated in FIG. 9, the position at which the ink cartridge 1 is disposed in a later-described cartridge receptacle 11 of the cartridge receiver 108 (see FIG. 2) is defined as a position P3. On the other hand, the position at which the ink cartridge 1 is not disposed in the cartridge receptacle 11 is defined as a position P4. When the ink cartridge 1 is at the position P4, a front end 1*b* of the ink cartridge 1 is disposed frontward beyond a rear surface 6*a* of the cover 6 that is assumed to be at the first position P1 (see FIG. 2). Therefore, when the ink cartridge 1 is not disposed at the appropriate position P3, the rear surface 6*a* of the cover 6 makes contact with the front end 1*b* of the ink cartridge 1 when closing the cover 6. As a consequence, the cover 6 does not close.

Figure 3A:
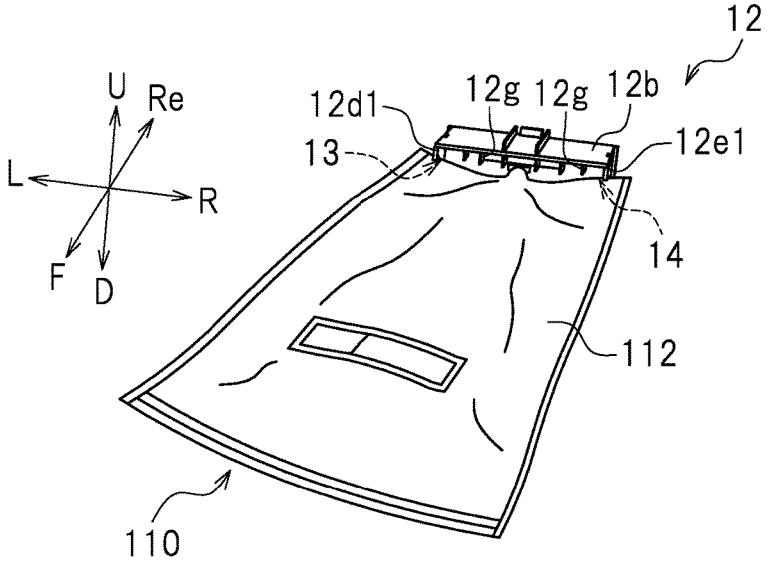
FIG. 3A is a perspective view illustrating an ink container according to a preferred embodiment of the present invention that is provided with an adapter.
Figure 3B:
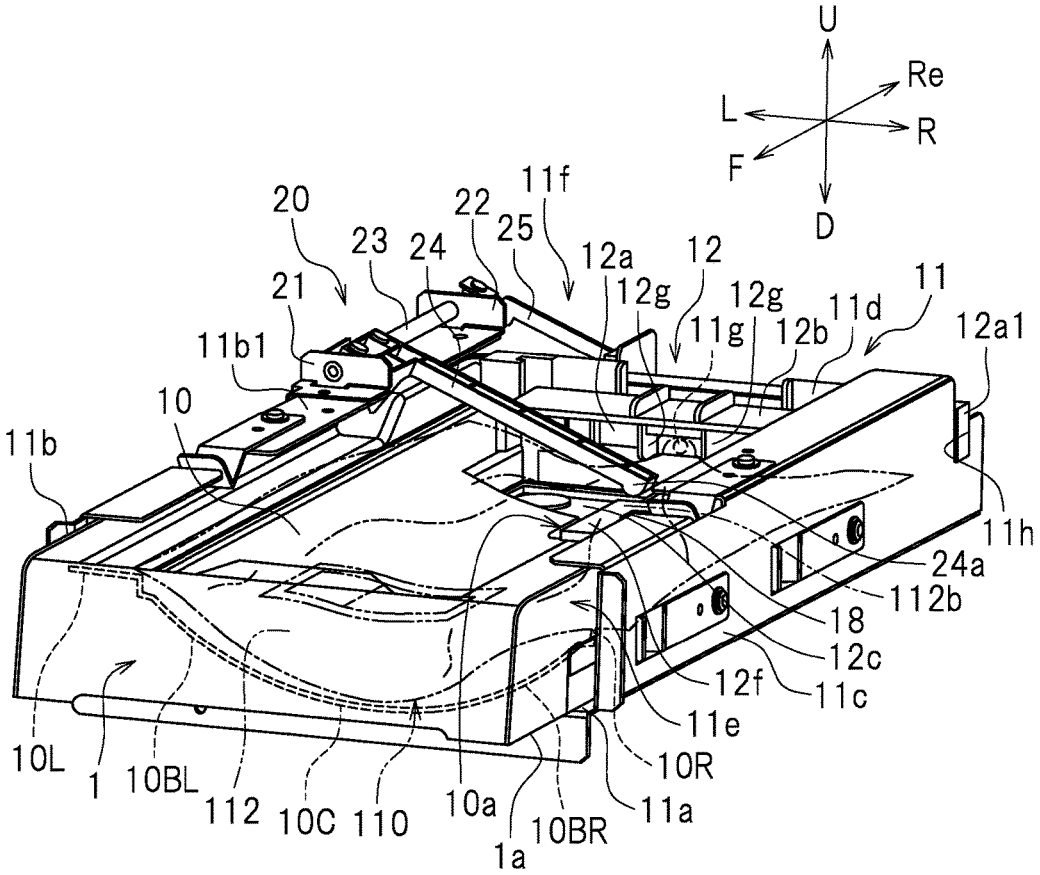
FIG. 3B is a perspective view illustrating an ink cartridge according to a preferred embodiment of the present invention in which the ink container provided with the adapter is disposed.

As illustrated in FIG. 3B, the cartridge receiver 108 (see FIG. 2) is provided with the cartridge receptacle 11 that corresponds to the ink cartridge 1 to be accommodated therein. The ink cartridge 1 is disposed in a predetermined position in the cartridge receptacle 11, such that it is accommodated in the cartridge receiver 108. Thus, the ink cartridge 1 is disposed in the cartridge receiver 108 via the cartridge receptacle 11. The cartridge receptacle 11 includes a lower surface 11*a*, a left wall 11*b* connected to the left end of the lower surface 11*a*, a right wall 11*c* connected to the right end of the lower surface 11*a*, and a rear surface 11*d* connected to the rear end of the lower surface 11*a*, the rear end of the left wall 11*b*, and the rear end of the right wall 11*c*. With such a configuration, an opening 11*e* is provided in a front portion of the cartridge receptacle 11, and an opening 11*f* is provided in an upper portion of the cartridge receptacle 11. Each of the left wall 11*b* and the right wall 11*c* includes a groove 11*h* into which a later-described rib 12*a*1 of an adapter 12 is to be fitted when positioning the adapter 12 relative to the ink cartridge 1. The ink cartridge 1 is inserted through the opening 11*e* of the cartridge receptacle 11. When inserting the ink cartridge 1, the lower surface 1*a* of the ink cartridge 1 slides over the lower surface 11*a* of the cartridge receptacle 11. This allows the ink cartridge 1 to be inserted easily into the cartridge receptacle 11. A needle 11*g* extending frontward and having a flow passage therein is provided at the center of the rear surface 11*d* of the cartridge receptacle 11.

Here, an adapter to be fitted to the ink container 110 (see FIG. 2) in accordance with the present preferred embodiment will be described below. Before the ink container 110 is placed in the ink cartridge 1, the ink container 110 is fitted with an adapter 12 as shown in FIG. 3A. Then, the ink container 110 fitted with the adapter 12 is placed at a predetermined position in the ink cartridge 1. The adapter 12 is attachable to and detachable from the ink container 110. More specifically, the adapter 12 is attachable to and detachable from a portion of the ink container 110 that is near an ink container cap 111 (see FIG. 5).

Figures 1, 4:
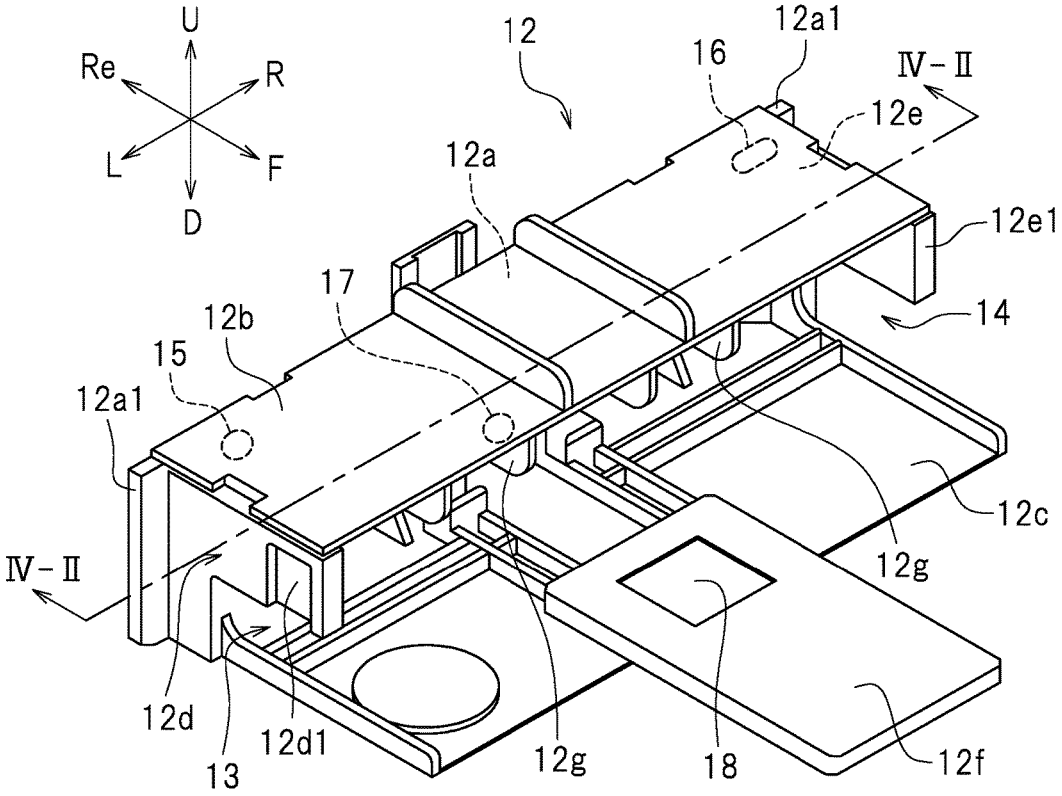
Figures 2, 4:
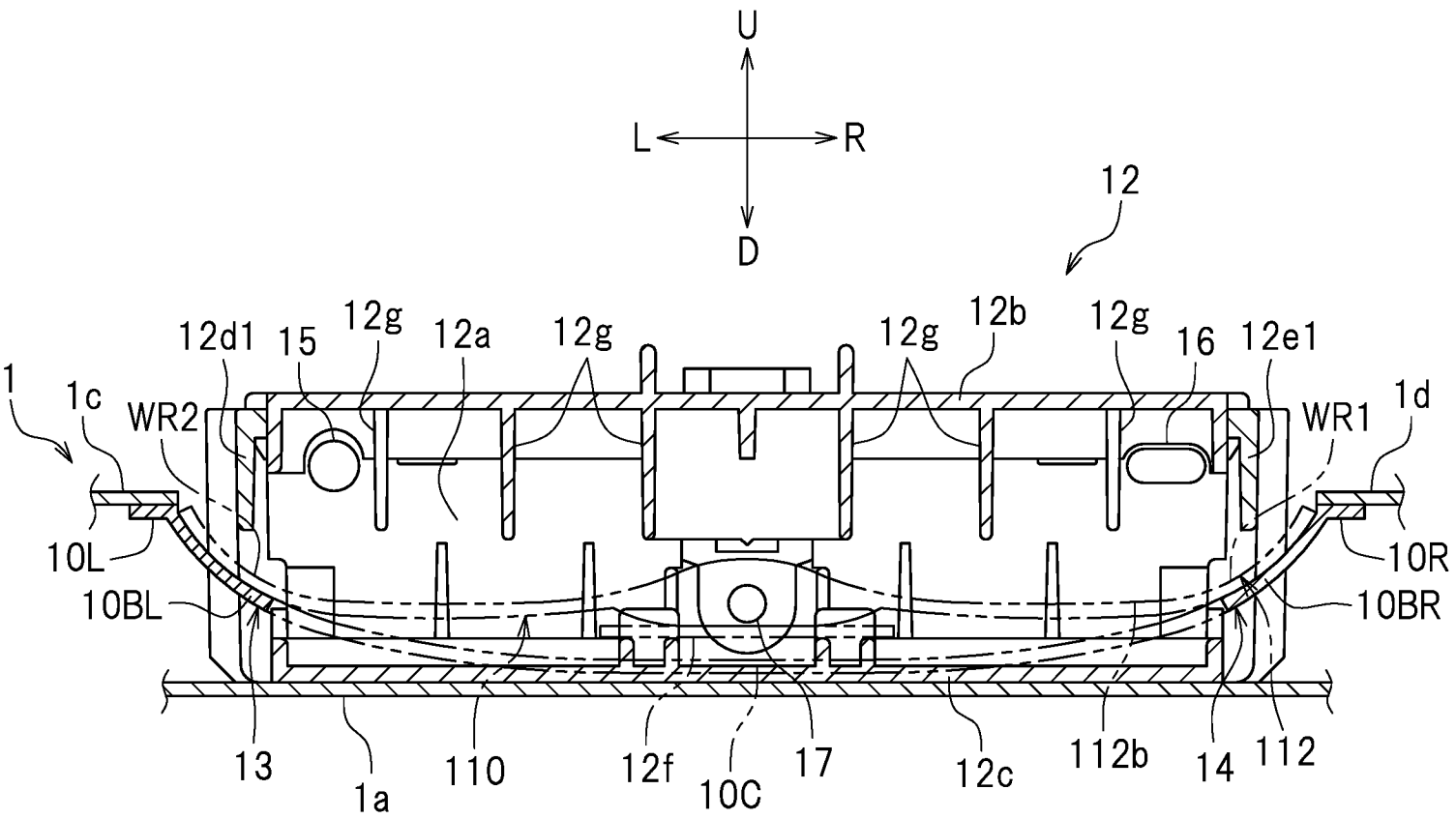

As illustrated in FIG. 4-1, the adapter 12 includes a rear surface 12*a*, an upper surface 12*b* connected to an upper end of the rear surface 12*a*, a lower surface 12*c* connected to a lower end of the rear surface 12*a* and extending frontward relative to a front end of the upper surface 12*b*, a left wall 12*d* connected to a left end of the upper surface 12*b*, and a right wall 12*e* connected to a right end of the upper surface 12*b*. A left portion and a right portion of the rear surface 12*a* have respective ribs 12*a*1 provided thereon. The left wall 12*d* includes a left protruding portion 12*d*1 spaced upward from a left portion of the lower surface 12*c* and protruding frontward. As a result, a gap 13 is provided between a lower end of the left protruding portion 12*d*1 and the left portion of the lower surface 12*c*. Likewise, the right wall 12*e* includes a right protruding portion 12*e*1 spaced upward from a right portion of the lower surface 12*c* and protruding frontward. As a result, a gap 14 is provided between a lower end of the right protruding portion 12*e*1 and the right portion of the lower surface 12*c*. A plurality of ribs 12*g*, each preferably having a thin plate shape, are provided on the lower surface of the upper surface 12*b* so as to be arrayed in a lateral direction at regular or approximately regular intervals. As illustrated in FIG. 4-2, the length of each of the ribs 12*g* along the vertical direction is the same or substantially the same as that length of the left protruding portion 12*d*1 and the right protruding portion 12*e*1. As illustrated in FIG. 4-1, the length of each of the ribs 12*g* along the longitudinal direction is shorter than the length of the left protruding portion 12*d*1 and the right protruding portion 12*e*1. With the ink container cap 111 (see FIG. 5) disposed at a predetermined position in the rear surface 12*a* of the adapter 12, a rear portion of a later-described main body 112 is placed in the gap 13 and the gap 14. More specifically, as illustrated in FIG. 4-2, a left portion in a rear portion of a later-described upper surface 112*b* of the main body 112 is inserted through the gap 13 without making contact with the left protruding portion 12*d*1. A right portion in the rear portion of the upper surface 112*b* of the main body 112 is inserted through the gap 14 without making contact with the right protruding portion 12*e*1. The upper surface 112*b* of the main body 112 is not in contact with the ribs 12*g*. Such a configuration allows the rear portion of the main body 112 to be positioned relative to the adapter 12 without receiving a pressing force from the adapter 12, i.e., in a free condition. Note that in FIG. 4-2, the arrangement condition of the upper surface 112*b* of the main body 112 is shown by the dash-dot-dot lines.

A circular hole 15 is provided in a left portion of the rear surface 12*a* of the adapter 12, and a long hole 16 is provided in a right portion of the rear surface 12*a*. A left portion and a right portion of the rear surface 11*d* of the cartridge receptacle 11 (see FIG. 3B) are provided with respective positioning pins extending frontward, which are not shown in the drawings. When placing the ink cartridge 1 (see FIG. 3B) containing the adapter 12 attached to the ink container 110 into the cartridge receptacle 11 (see FIG. 3B), which is provided in the cartridge receiver 108 (see FIG. 2), one of the positioning pins is inserted in the hole 15, and the other one of the positioning pins is inserted in the long hole 16. With such a configuration, the ink cartridge 1 is allowed to be positioned properly relative to the cartridge receptacle 11. In addition, a circular hole 17 is provided at the center of the rear surface 12*a* of the adapter 12. When fitting the adapter 12 to the ink container 110 (see FIG. 5), the ink container cap 111 (see FIG. 5) is inserted into the hole 17. In such a configuration, when placing the ink container 110 from which a portion of the ink container cap 111 protrudes outward through the hole 17 of the adapter 12 into the ink cartridge 1 to install the ink cartridge 1 into the cartridge receptacle 11, the needle 11*g* pierces into the ink container cap 111. This enables the ink in the main body 112 to flow out of the main body 112 and flow into the flow passage within the needle 11*g*.

As illustrated in FIG. 4-1, a securing portion 12*f* that is slidable in a longitudinal direction is provided at the center of the lower surface 12*c* of the adapter 12. The securing portion 12*f* preferably has a flat plate shape. The securing portion 12*f* preferably is rectangular or substantially rectangular. The securing portion 12*f* is able to be positioned between the center of the ink container 110 with respect to its longitudinal direction D1 (see FIG. 5) and an end portion 112*a* (see FIG. 5) of the ink container 110 on which the ink container cap 111 is provided, with the adapter 12 being attached to the ink container 110 (see FIG. 5). The securing portion 12*f* is preferably provided with an adhesive-bonding portion 18. In the present preferred embodiment, a double-sided tape, for example, may define the adhesive-bonding portion 18. However, the adhesive-bonding portion 18 is not limited to the double-sided tape, but it is possible to use other types of adhesive materials or securing materials. When fitting the adapter 12 to the ink container 110 (see FIG. 5), the securing portion 12*f* is positioned below the lower surface of the ink container 110. Thus, when fitting the adapter 12 to the ink container 110, the lower surface of the ink container 110 is secured to the securing portion 12*f* by the adhesive-bonding portion 18. This allows the ink container 110 to be positioned properly relative to the adapter 12. In addition, as illustrated in FIG. 3B, a cut-out portion 10*a* having a shape that matches the outer shape of the securing portion 12*f* of the adapter 12, in other words, a rectangular or substantially rectangular shape, is provided in a rear portion of a later-described support 10 of the ink cartridge 1. When placing the adapter 12 that has been positioned properly relative to the ink container 110 into a predetermined position of the ink cartridge 1, the securing portion 12*f* is placed into the cut-out portion 10*a*.

Next, the ink cartridge 1 will be described below. As illustrated in FIG. 3B, the ink cartridge 1 holds a portion of the main body 112 that is perpendicular or substantially perpendicular to the thickness direction of the main body 112. The ink cartridge 1 holds the ink container 110 so that the longitudinal direction D1 (see FIG. 5) of the main body 112 is set along the sub-scanning direction X (see FIG. 2) and that the ink container cap 111 (see FIG. 5) faces rearward. The ink cartridge 1 includes a support 10 that orients the main body 112 in a horizontally laid state. The length of the support 10 along the longitudinal direction is preferably longer than the length of the support 10 along the lateral direction (i.e., the width).

The support 10 is structured such that a central portion 10C of the support 10 with respect to the main scanning direction Y (see FIG. 2) is lower in height than a left portion 10L and a right portion 10R of the support 10. As illustrated in FIG. 4-2, the left portion 10L of the support 10 is connected to a left plate 1*c* disposed on the left of the ink cartridge 1, and the right portion 10R of the support 10 is connected to a right plate 1*d* disposed on the right of the ink cartridge 1. The support 10 preferably has a circular or substantially circular arc shape, for example. As illustrated in FIGS. 3B and 4-2, the support 10 includes a curved portion 10BL between the left portion 10L and the central portion 10C, the curved portion 10BL preferably having a curved shape such that its height becomes lower toward the central portion 10C. The support 10 includes a curved portion 10BR between the right portion 10R and the central portion 10C, the curved portion 10BR preferably having a curved shape such that its height becomes lower toward the central portion 10C. When the ink container 110 is placed on the support 10 having such a shape, the curved portion 10BR and the curved portion 10BL respectively support later-described welded regions WR1 and WR2 of the ink container 110. As the remaining amount of the ink in the main body 112 gradually decreases, the ink tends to gather at the center of the main body 112 with respect to the lateral direction. The welded regions WR1 and WR2 of the ink container 110 will be described in detail later. Note that in FIG. 4-2, the ink container 110 is depicted by dash-dot-dot lines, and the ink cartridge 1 is also depicted by the cross-sectional view and dash-dot-dot lines, in order to facilitate understanding.

Figure 5:
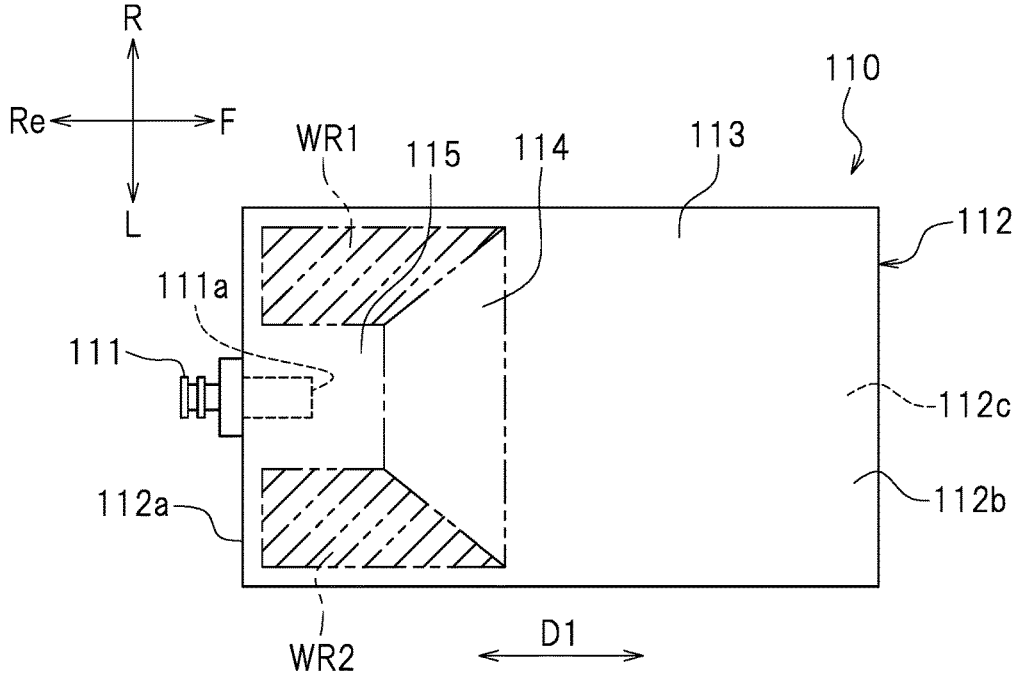
FIG. 5 is a plan view illustrating an ink container according to a preferred embodiment of the present invention.

Next, the ink container 110 according to the present preferred embodiment will be described below. As illustrated in FIG. 5, the ink container 110 includes the ink container cap 111 and the main body 112 including an ink. The ink container cap 111 is connected at the center or approximate center of one end portion 112*a* of the main body 112 with respect to the longitudinal direction D1. A portion of the ink container cap 111 is inserted in the main body 112. The main body 112 is preferably has a rectangular or substantially rectangular shape. The main body 112 includes an upper surface 112*b* and a lower surface 112*c*, each of which preferably has a rectangular or substantially rectangular shape.

The main body 112 includes an ink-filled portion 113, an ink outflow portion 114 connected to the ink-filled portion 113, and an ink supply portion 115 connected to the ink outflow portion 114 therein. The ink-filled portion 113 preferably has a constant or substantially constant width. The ink outflow portion 114 preferably has a width progressively narrowing from the ink-filled portion 113. The ink outflow portion 114 is positioned closer to the ink container cap 111 relative to the center of the main body 112 with respect to the longitudinal direction D1. A portion of the ink container cap 111 is inserted in the ink supply portion 115. The ink supply portion 115 preferably has a constant or substantially constant width that is narrower than the width of the ink-filled portion 113. The ink outflow portion 114 and the ink supply portion 115 preferably are formed by welding the upper surface 112*b* and the lower surface 112*c* of the main body 112 together, for example. As illustrated in FIG. 5, the main body 112 is preferably provided with the two welded regions WR1 and WR2 indicated by hatched areas. Each of the welded regions WR1 and WR2 preferably has a trapezoidal shape when viewed in plan, for example.

Next, a non-limiting example of a method for detecting the remaining amount of ink in the main body 112 (see FIG. 5) will be described below. As illustrated in FIG. 3B, a plate 11*b*1 protruding rightward is connected to the left wall 11*b* of the cartridge receptacle 11. The plate 11*b*1 is provided with a sensor lever 20 to detect the remaining amount of ink in the main body 112. In the following, the sensor lever 20 will be described.

Figure 8:
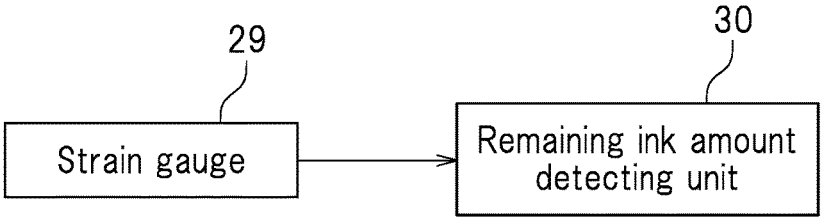
FIG. 8 is a block diagram illustrating a detector that detects a remaining ink amount according to a preferred embodiment of the present invention.

The sensor lever 20 includes plate-shaped shaft supports 21 and 22 extending upward and spaced apart from each other on the plate 11*b*1, a pivot shaft 23 connected to the shaft supports 21 and 22 and pivotable about the axis, and a sensor lever 24 secured to the pivot shaft 23 and pivotable about the axis of the pivot shaft 23. The sensor lever 20 also includes a detection lever 25 secured to a rear end portion of the pivot shaft 23 and pivotable about the axis of the pivot shaft 23 in association with pivoting of the sensor lever 24, and a metal piece 28 (see FIG. 7) in contact with a tip of the detection lever 25 and elastically deformed by receiving a force from the detection lever 25. As illustrated in FIG. 8, the sensor lever 20 further includes a strain gauge 29 and a remaining ink amount detector 30, which includes, for example, a microcomputer.

Figure 6:
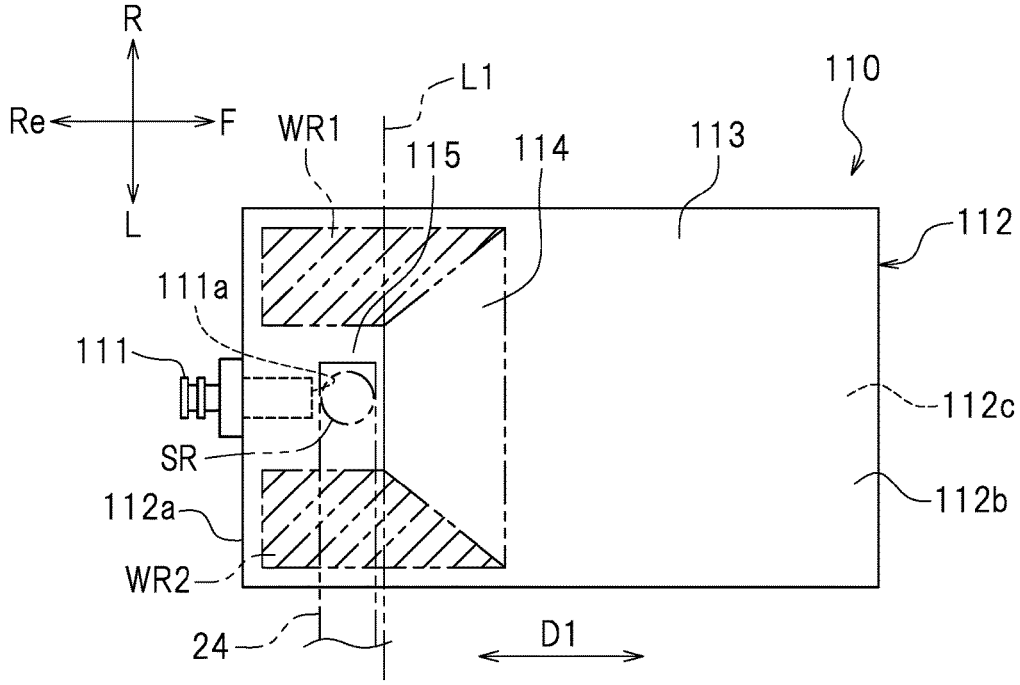
FIG. 6 is a plan view illustrating a contact point of a sensor lever on an ink container according to a preferred embodiment of the present invention.

As illustrated in FIG. 3B, the sensor lever 24 extends obliquely rightward and downward. A tip 24*a* of the sensor lever 24 is disposed in contact with the upper surface 112*b* of the main body 112. The tip 24*a* of the sensor lever 24 is in contact with a contact region SR shown in FIG. 6. The contact region SR is a portion of the upper surface 112*b* of the main body 112 that is located frontward relative to a front end 111*a* of the ink container cap 111 inserted in the main body 112. More specifically, the contact region SR is a portion in the ink supply portion 115, which is positioned rearward relative to the ink outflow portion 114, that is located frontward relative to the front end 111*a* of the ink container cap 111. In the main body 112, the region near the front end 111*a* of the ink container cap is a region in which the ink remains just before the ink in the main body 112 is completely used. When the tip 24*a* of the sensor lever 24 is brought into contact with the portion near the front end 111*a* of the ink container cap 111, it is possible to properly detect the amount of ink remaining in the main body 112 without being adversely affected by the bulge of the main body 112 caused by the front end 111*a*. It should be noted that the tip 24*a* of the sensor lever 24 should be in contact with a portion of the upper surface 112*b* that is rearward relative to the boundary line L1 between the ink outflow portion 114 and the ink supply portion 115 and also frontward relative to the front end 111*a* of the ink container cap 111.

Like the sensor lever 24, the detection lever 25 extends obliquely rightward and downward, as illustrated in FIG. 7. Here, a plate-shaped support 31 is secured to the rear surface 11*b* of the cartridge receptacle 11. A pair of block-shaped holders 26 and 27 are provided on the support 31 so as to be spaced apart from each other. A metal piece 28 is clamped between the holder 26 and the holder 27. The thickness of the metal piece 28 is such that it can be elastically deformed by receiving an external force. A tip 25*a* of the detection lever 25 is in contact with an upper surface of the metal piece 28. The strain gauge 29 (see FIG. 8) is disposed on a lower surface of the metal piece 28. When the metal piece 28 is deformed by receiving a force from the tip 25*a* of the detection lever 25, the strain gauge 29 outputs a voltage corresponding to the strain produced in the metal piece 28. The remaining ink amount detector 30 detects the remaining amount of the ink in the main body 112 (see FIG. 6) according to the voltage output by the strain gauge 29.

In such a configuration, in the initial state, the tip 24*a* of the sensor lever 24 (see FIG. 3B) is in contact with the contact region SR (see FIG. 6), and the tip of the detection lever 25 is in contact with the upper surface of the metal piece 28 to such a degree that the metal piece 28 does not bend. Then, as the remaining amount of the ink in the main body 112 decreases, the sensor lever 24 pivots while maintaining the contact with the main body 112. This causes the detection lever 25 to also pivot in association with the pivoting of the sensor lever 24. As a result, the tip 25*a* of the detection lever 25 causes the metal piece 28 to bend downward. The strain gauge 29 (see FIG. 8) outputs a voltage corresponding to the strain amount of the metal piece 28 that has been bent downward. Thus, the remaining ink amount detector 30 detects the remaining ink amount according to the output voltage.

Then, as illustrated in FIG. 7, an ink tube joint 40 is provided in the cartridge receiver 108 (see FIG. 2). More specifically, the ink tube joint 40 is provided on the rear surface 11*d* of the cartridge receptacle 11 disposed in the cartridge receiver 108. A rear portion of the ink tube joint 40 is connected to an ink tube 41 connected to the ink head 107 (see FIG. 1). Note that FIG. 7 depicts only a portion of the ink tube 41. A front portion of the ink tube joint 40 is provided with the needle 11*g* (see FIG. 3B). As described previously, the flow passage in communication with the ink tube 41 is inside the needle 11*g*. When the ink cartridge 1 (see FIG. 3B) holding the ink container 110 (see FIG. 5) is inserted into the cartridge receptacle 11, the needle 11*g* pierces into the main body 112 through the ink container cap 111 (see FIG. 5). This causes the ink in the main body 112 to flow into the ink tube 41 through the flow passage of the needle 11.

As illustrated in FIG. 7, an ink tub 42 is provided below the ink tube joint 40. The ink tub 42 is disposed rearward relative to the cartridge receptacle 11. It is also possible that a portion of the ink tub 42 may overlap a portion of the cartridge receptacle 11 along the longitudinal direction.

The ink tub 42 opens upwardly. The ink tub 42 receives and stores the ink that leaks downward from, for example, the connecting portion between the ink tube joint 40 and the ink tub 41. The ink tub 42 extends in a lateral direction. The ink tub 42 has the same or approximately the same length as the length of the main housing 101 along the lateral direction.

An ink absorber 43 to absorb the ink is provided in the ink tub 42. The ink absorber 43 may be, for example, a sponge. The ink absorber 43 is disposed on a bottom portion of the ink tub 42. The ink absorber 43 extends in a lateral direction. The ink absorber 43 has the same or approximately the same length as the inner dimension of the ink tub 42 along the lateral direction. It is also possible to prepare a plurality of ink absorbers 43 with a shorter length and provide the plurality of ink absorbers 43 in the ink tub 42 so as to be spaced apart from each other. When the ink absorber 43 sufficiently absorbs the ink stored in the ink tub 42, the ink absorber 43 may be replaced. Alternatively, the ink absorber 43 may be used repeatedly by removing the absorbed ink therefrom.

As thus far described, the present preferred embodiment enables the ink to gather at the center of the main body 112 easily from the left and right regions in the main body 112 because the central portion 10C of the support 10 for supporting the ink container 110 is lower in height than the left portion 10L and the right portion 10R. In other words, it is possible to gather the ink, so to speak, such that the ink is collected at one point in the main body 112. This prevents a large amount of ink from remaining in the main body 112 and allows the ink to flow out through the ink container cap 111 adequately. Therefore, it becomes possible to use up the ink in the main body 112 adequately. As a result, the cost of the ink is able to be reduced.

In addition, the present preferred embodiment enables the ink to gather at the center of the main body 112 more easily from the left and right regions in the main body 112. This inhibits a large amount of ink from remaining in the main body 112.

Moreover, the present preferred embodiment enables the lower surface 112*c* of the main body 112 to be secured to the securing portion 12*f* of the adapter 12 via the adhesive-bonding portion 18. This prevents the position of the ink container 110 from being misaligned relative to the ink cartridge 1 even if, for example, the ink cartridge 1 is moved or dropped after the adapter 12 fitted to the ink container 110 has been installed to the ink cartridge 1. As a result, the ink is prevented from scattering in the main body 112, which results from the misalignment.

Moreover, the present preferred embodiment enables a portion of the lower surface 112*c* of the main body 112 that is between the center of the ink container 110 with respect to the longitudinal direction D1 and the end portion 112*a* on which the ink container cap 111 is provided to be secured to the securing portion 12*f* of the adapter 12 via the adhesive-bonding portion 18. This makes it possible to lower the height of a portion near the outlet of the main body 112. As a result, it is possible to prevent formation of ink puddles of unused ink in the main body 112.

Furthermore, in the present preferred embodiment, the securing portion 12*f* of the adapter 12 is disposed on the cut-out portion 10*a*. Thus, the circumferential wall of the cut-out portion 10*a* blocks movement of the securing portion 12*f*. Therefore, misalignment of the securing portion 12*f* is prevented.

In the present preferred embodiment, the ink cartridge 1 is preferably supported on the inclined portion 2, so that the ink cartridge 1 is inclined downward toward the ink tube joint 40. This allows the ink in the main body 112 to gather in a region near the ink container cap 111 easily.

In the present preferred embodiment, the ink tub 42 receives the ink that drips from the ink container 110 and flows down along the inclined portion 2 of the cartridge receiver 108 when the needle 11*g* of the ink tube joint 40 is pulled out from the ink container cap 111 that has been pierced by the needle 11*g*, i.e., when the ink cartridge 1 is removed together with the ink container 110. This prevents the ink from flowing down toward the main housing of the inkjet printer 100.

In addition, in the present preferred embodiment, the ink absorber 43 is preferably provided in the ink tub 42. This enables the ink in the ink tub 42 to be absorbed by the ink absorber 43. As a result, the ink storage capacity of the ink tub 42 is increased.

Furthermore, in the present preferred embodiment, the sensor lever 24 that is in contact with the main body 112 pivots as the remaining amount of the ink in the main body 112 decreases. When the sensor lever 24 pivots, the detection lever 25 accordingly pivots, causing the metal piece 28 to deform and producing strain in the metal piece 28. Such a configuration makes it possible to easily detect the amount of the ink remaining in the main body 112 according to the strain of the metal piece 28.

In the present preferred embodiment, when the ink cartridge 1 is not disposed at a predetermined position in the cartridge receptacle 11 of the cartridge receiver 108, the rear surface 6*a* of the cover 6 makes contact with the front end 1*b* of the ink cartridge 1, thus preventing the cover 6 from closing. This enables the operator to recognize misalignment of the ink cartridge 1 easily.

The present preferred embodiment enables a portion of the main body 112 near the ink container cap 111 to have an indented shape. This prevents formation of ink puddles of unused ink at the corners in the main body 112 and makes it easy to gather the ink of the ink-filled portion 113 at the ink outflow portion 114. In other words, it is possible to gather the ink such that the ink is concentrated at one point in the main body 112. This prevents a large amount of ink from remaining in the main body 112 and allows the ink to flow out through the ink container cap 111 adequately. As a result, it becomes possible to sufficiently use the ink in the main body 112.

The present preferred embodiment enables a portion of the main body 112 near the ink container cap 111 to have an indented shape easily by welding the upper surface 112*b* and the lower surface 112*c* of the main body 112.

Hereinabove, preferred embodiments of the present invention have been described. It should be noted, however, that the foregoing preferred embodiments are merely exemplary, and the present invention may be embodied in various other forms or preferred embodiments, for example, such as described below.

Figure 10:
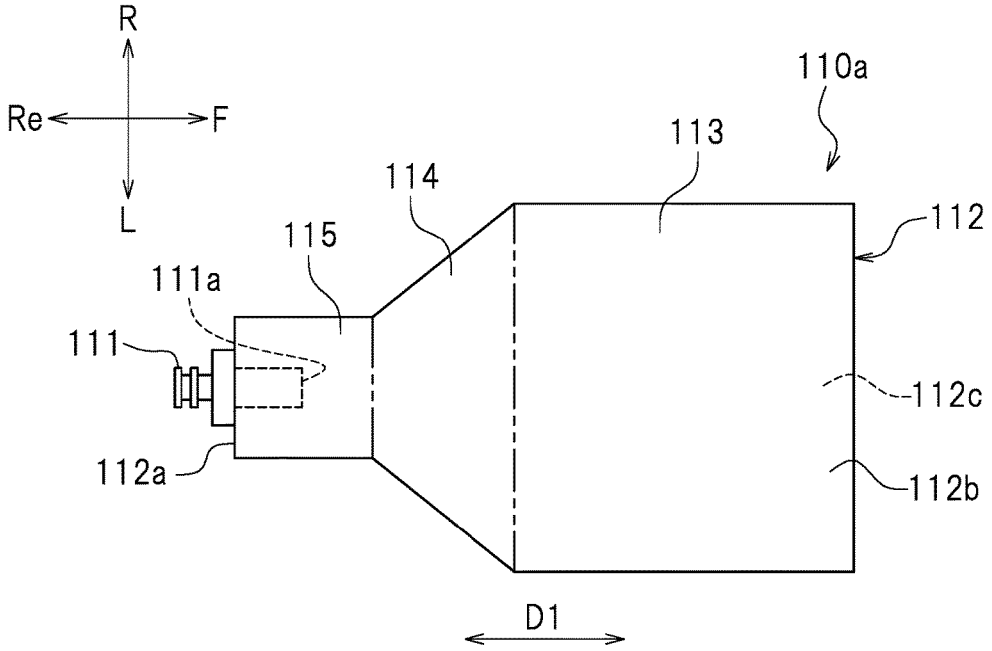
FIG. 10 is a plan view illustrating an ink container according to another preferred embodiment of the present invention.

In the foregoing preferred embodiment, the ink outflow portion 114 having a width progressively narrowing from the ink-filled portion 113 is preferably formed by forming the welded regions WR1 and WR2 by welding the upper surface 112*b* and the lower surface 112*c* of the main body 112 together, but the ink outflow portion 114 is not limited thereto. It is also possible to provide an ink container 110*a* in which the ink outflow portion 114 having a trapezoidal or substantially trapezoidal shape when viewed in plan has been provided in advance, as illustrated in FIG. 10.

Figure 11:
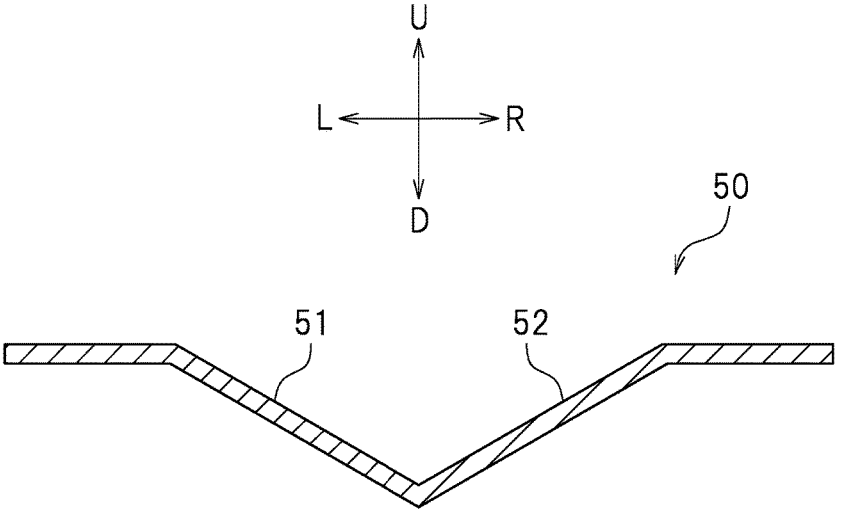
FIG. 11 is a cross-sectional view illustrating a support of an ink cartridge according to another preferred embodiment of the present invention.

In the foregoing preferred embodiment, the support 10 of the ink cartridge 1 preferably has a circular or substantially circular arc shape, but the support 10 is not limited thereto. As illustrated in FIG. 11, it is possible to provide a support 50 including a first support 51 inclined downward from the left portion toward the central portion in cross section, and a second support inclined downward from the right portion toward the central portion in cross section. Providing such a support 50 allows the ink to gather at the center of the main body 112 from the left and right regions in the main body 112 more easily. This prevents a large amount of ink from remaining in the main body 112.

Figure 12:
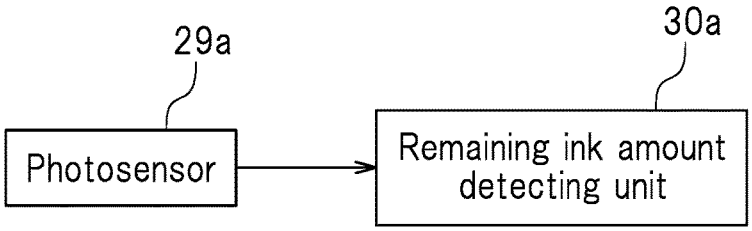
FIG. 12 is a block diagram illustrating a configuration of remaining ink amount detector according to another preferred embodiment of the present invention.

In the foregoing preferred embodiments, the amount of the ink remaining in the main body 112 is detected preferably using the strain gauge 29, but this is merely illustrative. It is also possible to use a photosensor 29*a* (see FIG. 12) that detects the position of the tip of the detection lever 25 by emitting light toward the tip of the detection lever 25 and receiving light reflected from the tip of the detecting lever 25. The photosensor 29*a* may be fixed between the holders 26 and 27. In that case, the remaining amount of the ink in the main body 112 is detected by, for example, a remaining ink amount detector 30*a* (see also FIG. 12) preferably including a microcomputer, according to the voltage output by the photosensor 29. This makes it possible to detect the amount of the ink remaining in the main body 112 easily according to the position of the tip of the detection lever 25.

Alternatively, it is possible to provide a structure in which the first support 51 has a stepped shape and the second support 52 also has a stepped shape.

Furthermore, when the ink cartridge 1 is not disposed at the predetermined position P3 in the cartridge receptacle 11, the operator maybe notified, for example, by lighting an indicator light that the positioning of the ink cartridge 1 relative to the cartridge receptacle 11 is inappropriate.

In the foregoing preferred embodiments, the inclined portion 2 of the cartridge receiver 108 preferably is a fixed type, in which it is inclined at a predetermined angle and fixed, but the inclined portion 2 is not limited thereto. It is also possible to provide a variable-type configuration in which the inclination angle of the inclined portion 2 is able to be varied depending on the amount of the ink remaining in the main body 112.

In the foregoing preferred embodiments, the amount of the ink remaining in the main body 112 is detected preferably using the sensor lever 24 and the detection lever 25, but this is merely illustrative. For example, the remaining ink amount may be detected by, for example, an optical position sensor.

In the foregoing preferred embodiments, the left plate 1*c*, the right plate 1*d*, and the lower surface 1*a* of the ink cartridge 1 as well as the support 10 are preferably separate elements, but they may be formed integrally with each other from plastic, for example. Likewise, the adapter 12 and the securing portion 12*f* are preferably separate elements in the foregoing preferred embodiments, but they may be formed integrally with each other from plastic, for example.

While preferred embodiments of the present invention have been described above, it is to be understood that variations and modifications will be apparent to those skilled in the art without departing from the scope and spirit of the present invention. The scope of the present invention, therefore, is to be determined solely by the following claims.

What is claimed is:

1. An inkjet recording apparatus comprising:

an ink cartridge;

an ink container disposed in the ink cartridge; wherein the ink container includes a main body, an ink, and a cap disposed at one end of the main body and extending partially in the main body;

the ink cartridge includes a support holding the ink container and supporting a portion of the main body;

the support includes a central portion that is lower in height than a left portion and a right potion located left and right of the central portion respectively, with respect to a main scanning direction of the inkjet recording apparatus; and the support includes a first support inclined downward from the left portion toward the central portion, and a second support inclined downward from the right portion toward the central portion.

2. The inkjet recording apparatus according to claim 1, wherein each of the left portion and the right portion of the support includes a circular arc shaped portion.

3. The inkjet recording apparatus according to claim 1, further comprising an adapter attachable to and detachable from the ink container and being installed to the ink cartridge with the adapter fitted to the main body; and the adapter has a flat plate shape, and includes a securing portion and an adhesive-bonding portion on the securing portion to secure the main body to the adapter.

4. The inkjet recording apparatus according to claim 3, wherein the securing portion is positioned between a center of the main body and the one end of the main body.

5. The inkjet recording apparatus according to claim 3, wherein the adapter includes a cut-out portion along an outer periphery of the securing portion, and the securing portion is disposed on the cut-out portion.

6. The inkjet recording apparatus according to claim 3, further comprising:

a pivot shaft;

a sensor lever secured to the pivot shaft and pivotable about an axis of the pivot shaft to come into contact with an upper surface of the main body that is located frontward relative to a portion of the cap;

a detection lever secured to the pivot shaft and pivoting about the axis of the pivot shaft in association with pivoting of the sensor lever;

a photosensor detecting a position of a tip of the detection lever, by emitting light toward the tip of the detection lever and receiving light reflected from the tip of the detection lever; and a remaining ink amount detector that detects a remaining amount of the ink in the main body according to a voltage output by the photosensor.

7. The inkjet recording apparatus according to claim 3, further comprising:

a pivot shaft;

a sensor lever secured to the pivot shaft and pivotable about an axis of the pivot shaft to come into contact with an upper surface of the main body that is located frontward relative to a portion of the cap;

a detection lever secured to the pivot shaft and pivoting about the axis of the pivot shaft in association with pivoting of the sensor lever;

a metal piece in contact with a tip of the detection lever;

a strain gauge provided on the metal piece and outputting a voltage corresponding to a strain of the metal piece caused by a force imparted by the detection lever; and a remaining ink amount detector detecting a remaining amount of the ink in the main body according to the voltage output by the strain gauge.

8. The inkjet recording apparatus according to claim 1, wherein the support includes a straight extending portion.

9. The inkjet recording apparatus according to claim 1, further comprising:

a cartridge receiver that accommodates the ink cartridge, and wherein the cartridge receiver includes an ink tube joint and an inclined portion;

the ink tube joint is connected to an ink tube and including a flow passage connected to the ink tube;

the ink tube joint includes a needle capable of piercing into the ink container to cause the ink in the main body to flow out; and the inclined portion is inclined downward toward the ink tube joint.

10. The inkjet recording apparatus according to claim 9, further comprising an ink tub that stores the ink and is below the ink tube joint.

11. The inkjet recording apparatus according to claim 10, further comprising an ink absorber that absorbs the ink and is provided in the ink tub.

12. The inkjet recording apparatus according to claim 9, wherein:

the cartridge receiver includes a left wall connected to a left end of the inclined portion, a right wall connected to a right end of the inclined portion, and a top surface connected to an upper end of the left wall and an upper end of the right wall;

the inclined portion, the left wall, the right wall, and the top surface together define an opening through which the ink cartridge is to be inserted;

the cartridge receiver further includes a cover pivotable between a first position to close the opening and a second position to open the opening; and when the ink cartridge is not disposed at a predetermined position in the cartridge receiver, a front end of the ink cartridge is disposed frontward relative to a rear surface of the cover at the first position.

13. An ink container for use in an inkjet recording apparatus, the ink container comprising:

a main body including an ink; and an ink outlet at one end of the main body and extending partially in the main body; wherein the main body includes an ink-holding portion having a first width, and an ink outflow portion that receives the ink from the ink-holding portion and provides the ink to the ink outlet;

the ink outflow portion has a second width that is less than the first width and progressively narrows from the ink-holding portion toward the ink outlet.

14. The ink container according to claim 13, wherein the ink outflow portion is defined by an upper surface and a lower surface of the main body joined together.

15. An ink cartridge comprising:

an ink container including a main body including an ink and a cap disposed at one end of the main body and extending partially in the main body; and a support that supports a portion of the main body; wherein the support includes a central portion that is lower in height than a left portion and a right portion of the support; and the support includes a first support inclined downward from the left portion toward the central portion, and a second support inclined downward from the right portion toward the central portion.

* * * * *